United States Patent [19]

Nishikawa et al.

[11] 4,135,811

[45] Jan. 23, 1979

[54] ELECTROPHOTOGRAPHIC APPARATUS

[75] Inventors: Masaji Nishikawa, Hachioji; Eiichi Sato, Tama; Kazuhisa Yanagisawa, Mitaka, all of Japan

[73] Assignee: Olympus Optical Company Limited, Tokyo, Japan

[21] Appl. No.: 882,902

[22] Filed: Mar. 1, 1978

[30] Foreign Application Priority Data

Mar. 4, 1977 [JP] Japan ..... 52-23667

[51] Int. Cl.[2] ..... G03G 15/00

[52] U.S. Cl. ..... 355/3 SC

[58] Field of Search ..... 355/3 SC, 3 R, 14

[56] References Cited

U.S. PATENT DOCUMENTS

| | | | |
|---|---|---|---|
| 3,811,765 | 5/1974 | Blake | 355/3 SC |
| 4,040,731 | 8/1977 | Nishikawa | 355/3 SC |
| 4,046,466 | 9/1977 | Ando et al. | 355/3 SC |

*Primary Examiner*—Richard L. Moses

*Attorney, Agent, or Firm*—Haseltine, Lake & Waters

[57] ABSTRACT

An electrophotographic apparatus comprises a photosensitive screen drum of a radius $r_1$ having a number of apertures formed therein and rotating through a printing or charging area having a width W at a constant peripheral velocity $v_1$, a record medium such as a charge transferring drum of a radius $r_d(r_2 = r_1)$ arranged opposite to the screen drum with a distance d at the printing area and rotating through the printing area at a constant peripheral velocity $v_2$, means for forming on the screen drum an electrostatic latent image of a document to be copied, and means for generating a corona ion stream passing in the printing area through the apertures of the screen drum, whereby the corona ion stream is modulated with an electric field formed in or near the apertures of the screen drum so as to form on the transferring drum a charge image corresponding to the latent image on the screen drum. The screen drum and transferring drum are rotated at a velocity ratio $k = v_2/v_1$ which satisfies the following equation.

for $r_2 > r_1$ $$\frac{r_2(2r_1+d)}{r_1(2r_2+d)} < k < \frac{r_2(2r_1+d)}{r_1(2r_2+d)} + \frac{r_2(r_2-r_1)(2r_1+d)(r_1+r_2+d)}{\sqrt[3]{4}\, r_1(2r_2+d)^3} \cdot \left(\frac{W}{2r_1}\right)^2$$

for $r_2 < r_1$ $$\frac{r_2(2r_1+d)}{r_1(2r_2+d)} > k > \frac{r_2(2r_1+d)}{r_1(2r_2+d)} - \frac{r_2(r_1-r_2)(2r_1+d)(r_1+r_2+d)}{\sqrt[3]{4}\, r_1(2r_2+d)^3} \cdot \left(\frac{W}{2r_1}\right)^2$$

When the record medium is a copy paper, it is fed through the printing area along an arcuate passage having the radius $r_2$ at the constant peripheral velocity $v_2$.

6 Claims, 8 Drawing Figures

ELECTROPHOTOGRAPHIC APPARATUS

BACKGROUND OF THE INVENTION

The present invention relates to an image forming apparatus and particularly to an electrophotographic apparatus of a type using a photosensitive screen having a number of small apertures.

In such an electrophotographic apparatus on the photosensitive screen there is formed an electrostatic latent image corresponding to a document to be copied. For this purpose the photosensitive screen is usually formed by applying on a conductive metal mesh a photoconductive layer, an insulating layer, a conductive layer, etc.

It has been known from, for example Japanese Patent Publication Nos. 30,320/70 and 11,579/74 and Japanese Patent Laid-Open Publication Nos. 84,640/73 and 59,840/73 to form an electrostatic latent image on a dielectric record paper by passing an ion stream through the fine apertures of the screen, said ion stream being modulated with various electric fields produced in or near the apertures or to form a colored image on a plain paper by selectively charging floating ink particles by means of the modulated ion stream.

Further in usual electrophotographic apparatus it has been widely practised that the photosensitive body is formed as a drum and a toner image on the photosensitive drum is transferred onto a plain paper or a latent image on the drum is transferred onto an electrostatic copy paper or a coated paper.

In these known copying systems the photosensitive drum and a copying paper are traveled in an intimately contact manner and circumferential velocities of the drum and copy paper should be made equal to each other.

Further in the known systems an area or range where the transferring is effected is limited to an area in which the drum is substantially in contact with the transferring paper. This area is sometimes referred to as a printing or charging area.

It is also known from, for example Japanese Patent Publication No. 21,142/72 that the above mentioned photosensitive screen is formed as a drum and an image is formed on the record medium which travels through the printing area along a flat passage.

The present inventors have found that in order to effect an excellent copying with such an image forming apparatus of screen drum type a charging or printing width (measured in the traveling direction of record medium) produced by a printing corona charger must be very narrow. That is to say the width of the corona ion stream must be extremely small. If the printing width is made wide, image forming dots on the record medium are prolonged or expanded in the traveling direction of the record medium. Thus the definition or resolution of the copied image might be decreased. On the other hand if the printing width is made narrow, the printing speed has to be lowered and thus it is quite difficult to realize a high speed electrophotographic apparatus which is earnestly desired by many customers.

As explained above it is very difficult to find a solution which satisfies the above mentioned two mutually contradictory problems.

SUMMARY OF THE INVENTION

The present invention has for its object to provide a novel and useful electrophotographic apparatus of the kind using the photosensitive screen, in which use can be made of a charging or printing width as wide as possible and thus a high speed copying can be effected without deterioration of the image resolution by suitably determining a ratio of peripheral velocities of the photosensitive screen and the record medium in the printing area.

The electrophotographic apparatus according to the invention comprises a photosensitive screen having a number of fine apertures formed therein and traveling through a printing area along an arcuate passage having a radius $r_1$ at a constant peripheral velocity $v_1$; a record medium arranged opposite to the photosensitive screen with the minimum distance d in the printing area and traveling through the printing area along an arcuate passage having a radius $r_2$ ($r_2 \neq r_1$) at a constant peripheral velocity $v_2$; means for forming on the photosensitive screen an electrostatic latent image corresponding to a document to be copied; and means for generating a corona ion stream which passes in the printing area through the apertures of the screen to the record medium and has a printing or charging width W; wherein a ratio k of the peripheral velocities $v_1$ and $v_2$ of the photosensitive screen and record medium satisfies the following condition;

for $r_2 > r_1$ $$\frac{r_2(2r_1+d)}{r_1(2r_2+d)} < k = \frac{v_2}{v_1} \quad \frac{r_2(2r_1+d)}{r_1(2r_2+d)} + \frac{r_2(r_2-r_1)(2r_1+d)(r_1+r_2+d)}{\sqrt[3]{4}\, r_1(2r_2+d)^3} \cdot \left(\frac{W}{2r_1}\right)^2$$

for $r_2 < r_1$ $$\frac{r_2(2r_1+d)}{r_1(2r_2+d)} > k = \frac{v_2}{v_1} > \frac{r_2(2r_1+d)}{r_1(2r_2+d)} - \frac{r_2(r_2-r_1)(2r_1+d)(r_1+r_2+d)}{\sqrt[3]{4}\, r_1(2r_2+d)^3} \cdot \left(\frac{W}{2r_1}\right)^2$$

In a preferred embodiment of the invention said ratio k substantially satisfies the following condition;

$$k = \frac{v_2}{v_1} = \frac{r_2(2r_1+d)}{r_1(2r_2+d)} + \frac{r_2(r_2-r_1)(2r_1+d)(r_1+r_2+d)}{r_1(2r_2+d)^3} \cdot \left(\frac{W}{4r_1}\right)^2$$

BREIF DESCRIPTION OF THE DRAWINGS

DESCRIPTION OF THE PREFERRED EMBODIMENTS

Figure 1:
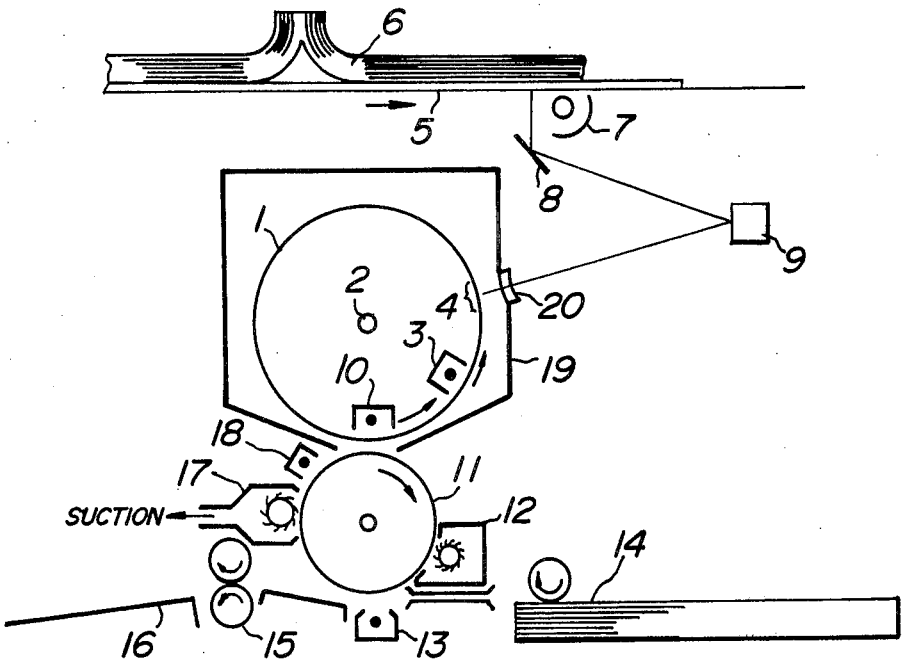
FIG. 1 is a diagrammatic view showing an embodiment of the electrophotographic apparatus according to the invention.

FIG. 1 illustrates diagramatically a whole construction of an embodiment of an electrophotogrphic apparatus according to the invention. In the present embodiment a photosensitive screen is formed as a drum 1. The screen drum 1 is formed by applying on a conductive metal mesh a photosensitive layer, an insulating layer, a conductive layer, etc. The screen drum 1 is arranged to rotate in an anti-clockwise direction at a constant speed. Along the circumference of the screen drum 1 is arranged a first corona charger 3 which charges homogeneously the screen drum 1. The homogeneously charged screen drum 1 is next subjected to an exposure of a document image at a light image exposing area 4 by means of a suitable image projecting system. A document stage 5 is made movable in a horizontal direction and a document 6 to be copied is placed on the stage 5. The document 6 is illuminated by a illuminating system 7 provided underneath the stage 5. A light reflected from the document 6 is projected onto the screen drum 1 by means of a mirror 8 and a projection lens 9. Then the homogenous charge on the screen drum 1 is selectively discharged in accordance with the projected light image so as to form on the screen drum 1 an electrostatic latent image corresponding to the light image of the document 6.

The screen drum 1 further rotates and comes into a printing or charging area at which a second corona charging device 10 is arranged. This printing corona charger 10 is arranged inside the screen drum 1 and generates an ion stream through meshes or fine apertures formed in the screen drum 1 to a record medium 11. In this embodiment the record medium 11 is formed as an electrostatic charge transferring drum arranged opposite to the second corona charger 10 with respect the screen drum 1. The record medium 11 is rotated in a clockwise direction at a constant speed. During the corona ion stream passes through the screen drum 1 the ion stream is modulated with electric fields formed in or near the apertures of the screen drum 1 in accordance with the latent image on the screen drum 1. Thus a secondary latent image corresponding to the primary latent image on the screen drum 1 is formed on the record medium 11.

As the record medium, i.e. transferring drum 11 rotates the latent image thereon is developed by toners at a developing device 12 and then the developed toner image is transferred onto a plain paper which is fed from a paper cassette 14. For effecting the transferring efficiently there is arranged a corona charger 13 which supplies corona ions onto the back of the paper. The transferred toner image on the paper is next thermally fixed by means of a heat roller 15. The paper having the toner image fixed is discharged onto a tray 16.

The transferring drum 11 is cleaned by a cleaning brush 17 to which an air suction is applied. Near the cleaning brush 17 is arranged an erasing corona charger 18 which cancels the electrostatic residual charge on the transferring drum 11 or charges homogeneously the drum 11 at a low potential of the same polarity as that of the toners. If an insulating surface layer of the transferring drum 11 is made of photosensitive material, the above mentioned discharging or erasing process may be carried out by means of light. The developing, transferring, fixing, cleaning, etc. are not essential for the present invention and any other processes may be utilized.

The screen drum 1 is surrounded by a cover 19 which makes the drum free from stray light, dust, etc. Moreover in the projecting optical system there may be included a concave or convex cylindrical lens 20 so as to compensate a unilateral distortion of the copied image due to a difference in diameters of the screen drum 1 and the transferring drum 11.

After a single copy is obtained the screen drum 1 further rotates and is again charged homogeneously by the first corona charger 3 and the above explained operations are repeated so as to make successive copies.

In the electrophotographic apparatus of the kind mentioned above the surface of the screen drum 1 on which the primary latent image has been formed travels through the charging or printing area along an arcuate passage having a radious $r_1$ and the record medium 11 passes through the printing area also along an arcuate passage having a radius $r_2$. Therefore if peripheral velocities $v_1$ and $v_2$ of the screen drum 1 and the record medium 11 are equal to each other and the radii $r_1$ and $r_2$ are equal to each other, the charge dots forming the secondary latent image on the record medium 11 tend to prolong or expand in the traveling direction of the record medium 11 during the passage though the printing area. Therefore the resolution of the copy image is liable to decrease. In order to minimize such dot expansion or prolongation it is necessary to determine an optimum relation between the velocities $v_1$ and $v_2$ with taking into account of the finite charging or printing width of the printing corona generator 10.

Figure 2:
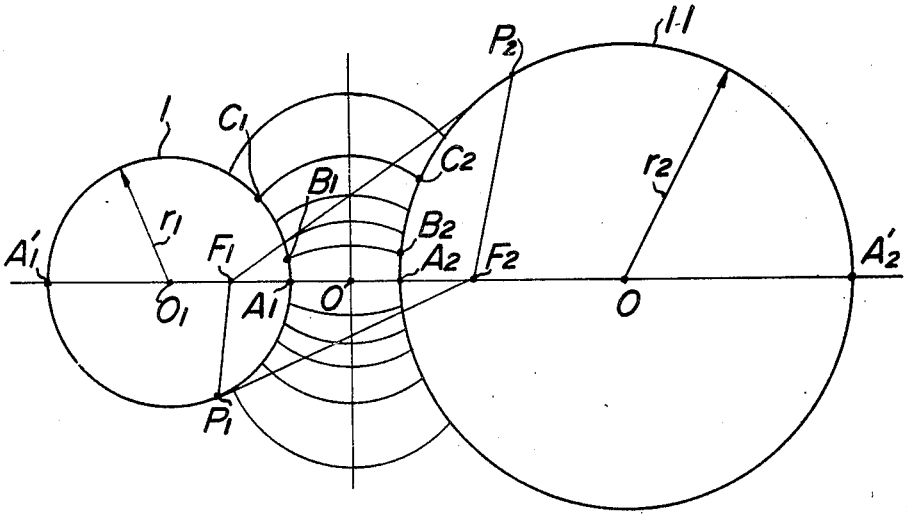
FIG. 2 is a diagram illustrating lines of electric force generated between a photosensitive screen drum and a transferring drum.

FIG. 2 illustrates in a simplified manner how to generate lines of electric force between the screen drum 1 having the radius $r_1$ and a center $O_1$ and the record medium 11 having the radius $r_2$ and a center $O_2$. It is certified by solving a Pisson's equation and applying a conformal mapping theory that when two conductive cylindrical bodies are arranged in parallel with each other, the electric field outside these cylindrical bodies is identical with a field which would be formed by a pair of imaginary conductive wires (extending in parallel to the cylindrical bodies) passing through points $F_1$ and $F_2$ situated on a segment between the centers $O_1$ and $O_2$. Further in this case the lines of electric force outside the cylindrical bodies correspond to cylindrical surfaces having a center O on a straight line which bisects vertically the segment $\overline{F_1F_2}$. Thus the ion stream passing through a point $A_1$ on the screen drum 1 travels along the line of electric force and reaches a point $A_2$ on the record medium 11. In the same manner the ion streams passing through points $B_1$ and $C_1$ move along the lines of electric force passing through the points $B_1$ and $C_1$, respectively and reach the record medium 11 at points $B_2$ and $C_2$, respectively.

Since the surface of the cylindrical body has the same potential, when a point $P_1$ is selected on the cylindrical body having the center $O_1$, a ratio of segments $\overline{F_1P_1}$ and $\overline{F_2P_1}$ is made constant.

$$(\overline{F_1P_1}/\overline{F_2P_1}) = \text{constant} \quad (1)$$

When particular points $A_1$ and $A_1'$ are selected as the point $P_1$, said points $A_1$ and $A_1'$ being intersecting points of the straight line passing through the center $O_1$ and $O_2$ and the cylindrical body 1, the following relation can be obtained:

$$(\overline{F_1A_1}/\overline{F_2A_1}) = (\overline{F_1A_1'}/\overline{F_2A_1'}) \quad (2)$$

Now it is defined that $\overline{OA_1} = d_1$, $\overline{OA_2} = d_2$ (therefore $d_1 + d_2 = d$) and $\overline{OF_1} = \overline{OF_2} = f$, then the equation (2) can be rewritten as follows:

$$\frac{f - d_1}{f + d_1} = \frac{(2r_1 + d_1) - f}{(2r_1 + d_1) + f} \quad (3)$$

In a similar manner when points $A_2$ and $A_2'$ are selected as a point $P_2$ on the cylindrical body 11, said points $A_2$ and $A_2'$ being crossing points between the line passing through the centers $O_1$, $O_2$ and the cylindrical body 11, the following equation can be obtained:

$$(\overline{F_2A_2}/\overline{F_1A_2}) = (\overline{F_2A_2'}/\overline{F_1A_2'}) \quad (4)$$

From this equation (4) one can obtain the following equation:

$$\frac{f - d_2}{f + d_2} = \frac{(2r_2 + d_2) - f}{(2r_2 + d_2) + f} \quad (5)$$

From the equations (3) and (5) there can be derived the following equation between $d_1$ and $d_2$ by canceling $f$.

$$d_1(2r_1+d_1) = d_2(2r_2 + d_2) \quad (6)$$

Upon considering $d_1 + d_2 = d$ this equation can be written as follows:

$$d_1 = \frac{d(2r_2 + d)}{2(r_1 + r_2 + d)}, \; d_2 = \frac{d(2r_1 + d)}{2(r_1 + r_2 + d)} \quad (7)$$

Figure 3:
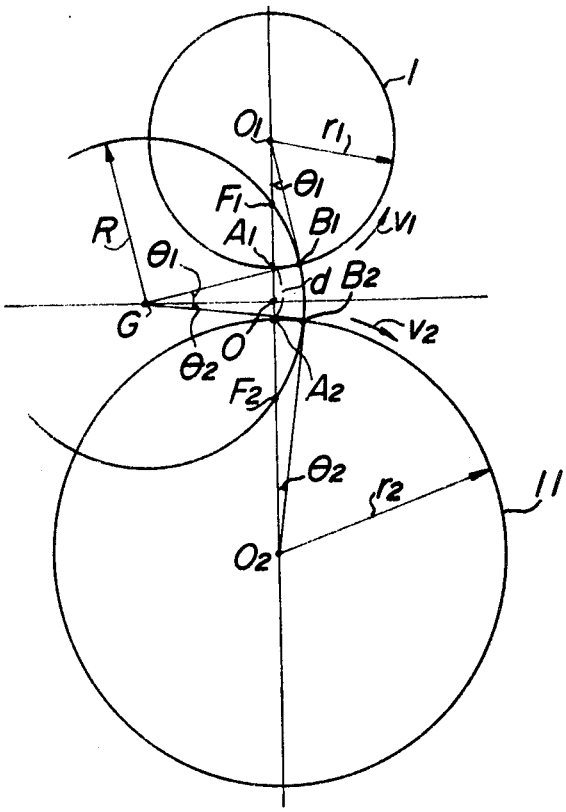
FIG. 3 is a diagram also showing the line of electric force.

FIG. 3 shows the screen drum 1 (radius $r_1$) and the record medium 11 (radius $r_2$) in the simplified manner. In FIG. 3 tangential lines passing through points $B_1$ and $B_2$ intersect at a single point G with the line which bisects the segment $\overline{F_1F_2}$. An arc $\widehat{B_1B_2}$ on a circle having a center G and a radius $\overline{GB_1} = \overline{GB_2} = R$ represents a line of electric force from the point $B_1$ to the point $B_2$. $\theta_1$ represents an angle made by segments $\overline{O_1B_1}$ and $\overline{O_1A_1}$ and $\theta_2$ an angle made by segments $\overline{O_2B_2}$ and $\overline{O_2A_2}$. Further the screen drum 1 and record medium 11 rotate in mutually opposite directions at circumferential velocities $v_1$ and $v_2$, respectively. From FIG. 3 the following relations can be derived.

$$r_1 \cos\theta_1 + R \sin\theta_1 = r_1 + d_1 \quad (8)$$

$$r_2 \cos\theta_2 + R \sin\theta_2 = r_2 + d_2 \quad (9)$$

From these equations the following equation can be obtained with respect to $\theta_1$ and $\theta_2$ by deleting R.

$$\sin(\theta_2+\alpha) = \frac{(r_2 + d_2)\sin\theta_1}{\sqrt{(r_2 \sin\theta_1)^2 + \{r_1(1-\cos\theta_1) + d_1\}^2}} \quad (10)$$

Wherein $\alpha$ is given by the following equation:

$$\tan\alpha = \frac{r_2 \sin\theta_1}{r_1(1 - \cos\theta_1) + d_1} \quad (11)$$

Now it may be considered that $\theta_1$ and $\theta_2$ (measured as radian unit) are smaller than 1 in usual case. Therefore where the equations (10) and (11) are expanded into power series and $\theta_2$ is represented by taking third order of $\theta_1$, the following approximation can be obtained:

$$\theta_2 = \frac{d_2}{d_1}\theta_1 [1 - \frac{1}{6d_1^2}\{d_1(3r_1 + d_1) - d_2(3r_2 + d_2)\}\theta_1^2] \quad (12)$$

By substituting $d_1$, $d_2$ in this equation for those given by the equation (7) the equation (12) can be rewritten into as follows:

$$\theta_2 = \frac{2r_1 + d}{2r_2 + d}\theta_1 [1 + \frac{(r_2 - r_1)(r_1 + r_2 + d)}{3(2r_2 + d)^2}\theta_1^2] \quad (13)$$

Since an arc $\widehat{A_1B_1} = r_1\theta_1$ and an arc $\widehat{A_2B_2} = r_2\theta_2$, the equation (13) can be further rewritten into the following equation:

$$\widehat{A_2B_2} = \widehat{A_1B_1}\frac{r_2(2r_1 + d)}{r_1(2r_2 + d)} [1 + \frac{(r_2 - r_1)(r_1 + r_2 + d)}{3(2r_2 + d)^2}\theta_1^2] \quad (14)$$

Thus one can obtain the following equation:

$$\frac{\widehat{A_2B_2}}{\widehat{A_1B_1}} = \frac{r_2(2r_1 + d)}{r_1(2r_2 + d)} + \frac{r_2(r_2 - r_1)(2r_1 + d)(r_1 + r_2 + d)}{3r_1(2r_2 + d)^3}\theta_1^2 \quad (15)$$

Further since the peripheral velocities $v_1$ and $v_2$ can be expressed as $$v_1 = r_1\dot{\theta}_1 \; (\dot{\theta}_1 = \frac{d\theta_1}{dt}) \text{ and } v_2 = r_2\dot{\theta}_2,$$

respectively, a ratio of these velocities $v_2/v_1$ can be represented as follows:

$$\frac{v_2}{v_1} = \frac{r_2(2r_1 + d)}{r_1(2r_2 + d)} + \frac{r_2(r_2 - r_1)(2r_1 + d)(r_1 + r_2 + d)}{r_1(2r_2 + d)^3}\theta_1^2 \quad (16)$$

If the record medium 11 is made flat at the printing or charging area, the equations (15) and (16) can be rewritten into the following equations (17) and (18), respectively by marking $r_2$ infinite:

$$\lim_{r_2\to\infty}(\frac{\widehat{A_2B_2}}{\widehat{A_1B_1}}) = (1 + \frac{d}{2r_1}) + (\frac{2r_1 + d}{24r_1})\theta_1^2 \quad (17)$$

$$\lim_{r_2\to\infty}(\frac{v_2}{v_1}) = (1 + \frac{d}{2r_1}) + (\frac{2r_1 + d}{8r_1})\theta_1^2 \quad (18)$$

Figure 4:
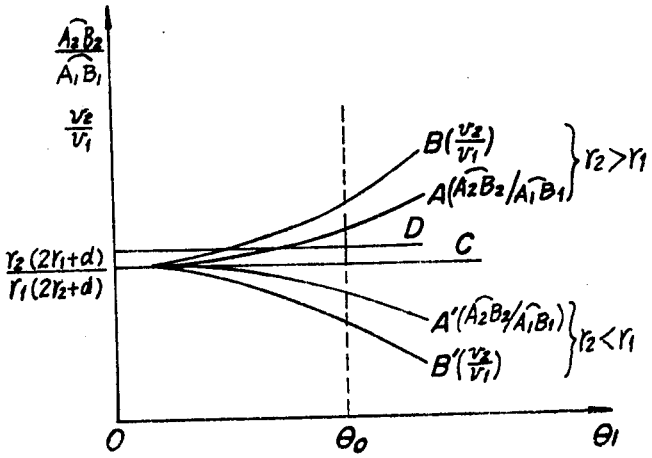
FIG. 4 is a graph showing a ratio of peripheral velocities of the screen drum and transferring drum with respect to a position in a printing area.

The equations (15) and (16) can be represented by curves A, A', B and B' in a graph shown in FIG. 4, in which an abscissa represents $\theta_1$ and an ordinate ($\widehat{A_2B_2}/\widehat{A_1B_1}$ and $v_2/V_1$). In this graph a line C represents a first term of the equations (15) and (16), i.e.

$$\frac{\widehat{A_2B_2}}{\widehat{A_1B_1}} = \frac{v_2}{v_1} = \frac{r_2(2r_1 + d)}{r_1(2r_2 + d)} \quad (19)$$

These curves make apparent the fact that in a range of small $\theta_1$ the ratio of speeds ($v_2/V_1$) can be equal to the ratio of arcs ($\widehat{A_2B_2}/\widehat{A_1B_1}$). But as $\theta_1$ becomes larger the curves B and B' become apart from the line C.

Now it is considered that the expansion or prolongation of the charge dots should be made as small as possible within a certain $\theta_1$ corresponding to a finite charging width. As far as a single dot is concerned it is possible to delete the expansion by changing the speed $v_2$ of the record medium 11 as shown by the curves B or B' in FIG. 4. But, in fact, a great number of dots are printed simultaneously and thus the remaining dots are prolonged even by changing the speed $v_2$ as stated above. Thus the record medium 11 should be rotated at a constant speed. Now the inventors have found that the prolongation or expansion of charge dots could be reduced to such an extent that the dot prolongation does not practically affect the quality of the copied image by selecting the ratio $v_2/v_1$ of the peripheral velocities of the screen drum 1 and the record medium 11 substantially as shown by a line D which is different from the line B for a given value of the charging or printing width $\theta_0$. This will be explained in greater detail hereinafter.

Figure 5:
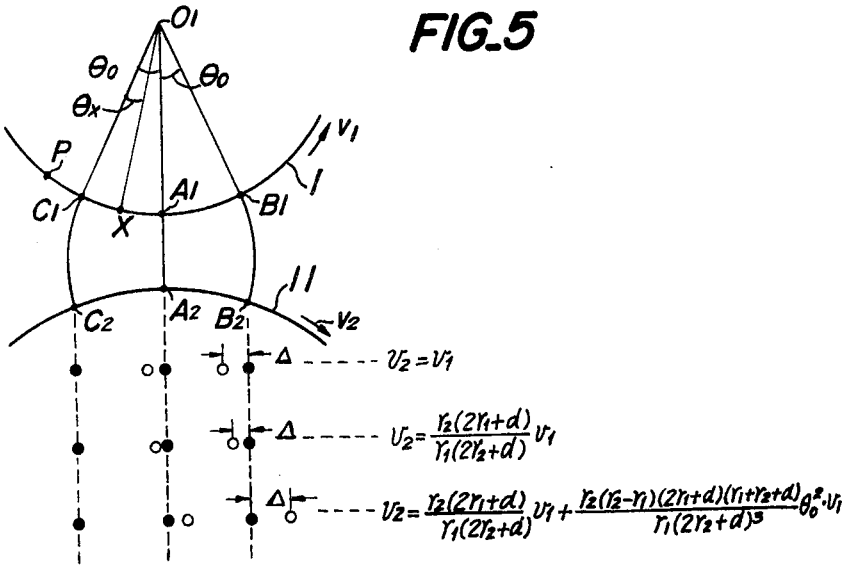
FIG. 5 is a diagram illustrating a relation between the ratio of the peripheral velocities of the screen drum and transferring drum and amounts of dot prolongation.

FIG. 5 illustrates a relation between the circumferential velocity $v_2$ of the record medium 11 and an amount $\Delta$ of the dot prolongation or expansion. For the sake of simplicity only a case of $r_2 > r_1$ is shown in FIG 5, but the similar relation is existent in case of $r_2 < r_1$. In FIG. 5 the charging width is equal to $2\theta_0$ and the screen drum 1 and the record medium 11 rotate at the constant speeds $v_1$ and $v_2$, respectively in the opposite directions as shown by arrows.

Now it is assumed that a point P on the screen drum 1 comes into the charging or printing area at a point $C_1$. The ion stream running from the point $C_1$ of the drum 1 to the record medium 11 forms a sharp charge dot on the record medium 11 at a point $C_2$ independent of the value of $v_2$ (because the speed of the ion stream is sufficiently higher than $v_1$ and $v_2$). Then the dot becomes prolonged in a course that the point P passes successively points $A_1$ and $B_1$. An amount of the dot expansion depends on the speed $v_2$. For example, consider a case of $v_2 = v_1 = r_1\dot{\theta}_1$. When the point P moves into the point $A_1$, a dot position found at the point $A_2$ (shown by solid black dot) preceeds to a dot position formed at the point $A_1$ (shown by a small circle), because a traveling speed of a leg porton of the line of electric force on the record medium is higher than the rotating speed $v_2$ of the record medium. This tendency becomes larger as the point P moves further toward the point $B_1$. In this manner the prolongation or expansion of the charge dot which has been formed after the point P has traveled over the whole charging or printing area $2\theta_0$ becomes extremely large.

Similarly when it is selected that $$v_2 = \frac{r_2(2r_1 + d)}{r_1(2r_2 + d)} v_1,$$

the dots formed during the point P moves through the points $A_1$, $B_1$ preceed to the dot formed at the point $C_2$. However in this case the moving speed of the leg portion of the line of electric force on the record medium 11 is substantially equal to the traveling speed of the record medium at a vicinity of the point $A_2$ and thus the amount of dot prolongation is smaller than that produced in case of $v_1 = v_2$. On the other hand if it is determined that $$v_2 = \frac{r_2(2r_1 + d)}{r_1(2r_2 + d)} v_1 + \frac{r_2(r_2 - r_1)(2r_1 + d)(r_1 + r_2 + d)}{r_1(2r_2 + d)^3} \theta_0^2 \cdot v_1,$$

the rotating speed of the record medium is always higher than the traveling speed of the leg portion of the line of electric force on the record medium. Thus the dot positions formed during the point P moves through the points $C_1$, $A_1$ and $B_1$ succeed the dot position which is formed at the point $C_2$. Therefore the direction of the dot prolongation is opposite to that of the previous case. At any rate the prolongation or expansion of dot occurs.

The nature of dot prolongation has been explained hereinbefore with reference to the three cases. Now a particular value of $v_2$ which can make the amount of dot prolongation minimum will be explained. For the sake of simplicity the following analysis will be made for only case of $r_2 > r_1$, but the similar analysis may be effected also for a case of $r_2 < r_1$. In the latter case only results are shown.

Now it is assumed that the circumferential velocity $v_2$ of the record medium 11 is higher than the circumferential velocity $v_1$ of the screen drum 1 by k times, that is to say $v_2 = kv_1$. Then in FIG. 3 the point $A_2$ rotates over a distance $kv_1t$ within a time period t.

$$kv_1t = kv_1\frac{\theta_1}{\dot{\theta}_1} = kv_1\frac{\theta_1}{v_1/r_1} = kr_1\theta_1$$

Then an amount $\delta(\theta_1)$ of the dot prolongation can be represented as follows:

$$\begin{aligned}\delta(\theta_1) &= \widehat{A_2B_2} - kv_1t \\ &= r_1\theta_1\left[\frac{r_2(2r_1 + d)}{r_1(2r_2 + d)} + \frac{r_2(r_2 - r_1)(2r_1 + d)(r_1 + r_2 + d)}{3r_1(2r_2 + d)^3}\theta_1^2\right] - kr_1\theta_1 \\ &= r_1\theta_1\left[\frac{r_2(2r_1 + d)}{r_1(2r_2 + d)} - k\right] + \frac{r_2(r_2 - r_1)(2r_1 + d)(r_1 + r_2 + d)}{3(2r_2 + d)^3}\theta_1^3\end{aligned} \tag{20}$$

It should be noted that the equation (20) can be obtained for a case that $\theta_1$ is denoted as shown in FIG. 3. In order to consider the actual dot prolongation it is preferrable to select in such a manner that a zero point $\theta_0 = 0$ lies on the segment $\overline{O_1C_1}$. Then the finite charging or printing area can be represented by $2\theta_0$ and a domain of variability of $\theta_1$ becomes $0 \leqq \theta_1 \leqq {}_0$. When $\theta_1$ is converted into $\theta_1 - \theta_0$ and $\delta(\theta_1)$ into $\delta(\theta_1) - \delta(\theta_o)$, the equation (20) can be rewritten into as follows:

$$\delta(\theta_1) - \delta(\theta_0) = r_1(\theta_1 - \theta_0)\left[\frac{r_2(2r_1 + d)}{r_1(2r_2 + d)} - k\right] + \frac{r_2(r_2 - r_1)(2r_1 + d)(r_1 + r_2 + d)}{3(2r_2 + d)^3}(\theta_1 - \theta_0)^3$$

$$\delta(\theta_0) = r_1\theta_0\left[\frac{r_2(2r_1 + d)}{r_1(2r_2 + d)} - k\right] + \frac{r_2(r_2 - r_1)(2r_1 + d)(r_1 + r_2 + d)}{3(2r_2 + d)^3}\theta_0^3$$

This equation can be further summerized into $$\delta(\theta_1) = r_1\theta_1 \left[\frac{r_2(2r_1 + d)}{r_1(2r_2 + d)} - k\right] + \frac{r_2(r_2 - r_1)(2r_1 + d)(r_1 + r_2 + d)}{3(2r_2 + d)^3}\theta_1(\theta_1^2 - 3\theta_0\theta_1 + 3\theta_0^2) \quad (21)$$

In the equations (20) and (21) k can be any value. Now several examples will be explained with various values of k.

(1) $k=1$, i.e. $v_2=v_1$ $$\delta(\theta_1) = \alpha\theta_1 + \beta\theta_1(\theta_1^2 - 3\theta_0\theta_1 + 3\theta_0^2) \quad (22)$$

$$= \theta_1\{\beta\theta_1^2 - 3\beta\theta_0\theta_1 + (\alpha + 3\beta\theta_0^2)\}$$

Wherein $$\alpha = r_1\left[\frac{r_2(2r_1 + d)}{r_1(2r_2 + d)} - 1\right] = \frac{d(r_2 - r_1)}{2r_2 + d} \quad (23)$$

$$\beta = \frac{r_2(r_2 - r_1)(2r_1 + d)(r_1 + r_2 + d)}{3(2r_2 + d)^3} \quad (24)$$

In case of $r_2 < r_1$, since $\alpha < 0$ and $\beta < 0$, the following equation can be obtained:

$$\delta(\theta_1) = -\theta_1\{|\beta|\theta_1^2 - 3|\beta|\theta_0\theta_1 + (|\alpha| + 3|\beta|\theta_0^2)\} \quad (22)'$$

Figure 6:
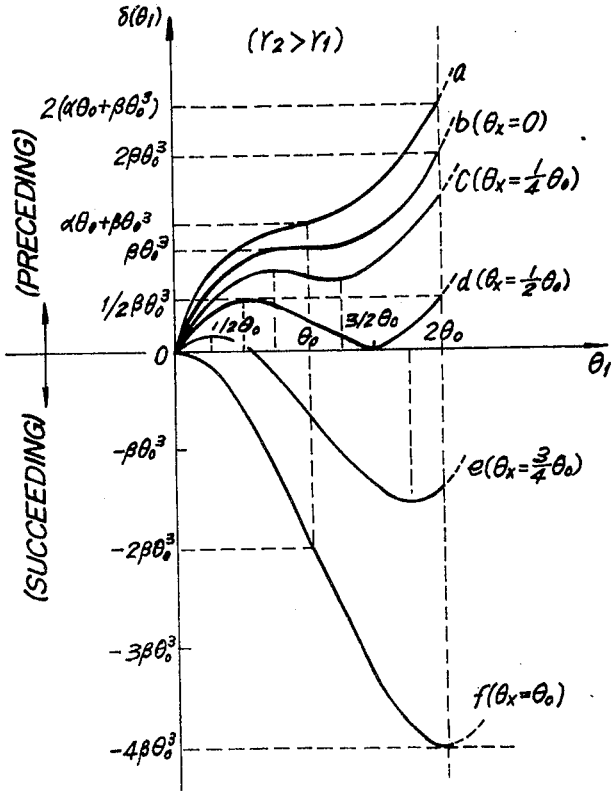
FIG. 6 and FIG. 7 are graphs showing a relation between the peripheral velocity ratio and amounts of dot prolongation.
Figure 7:
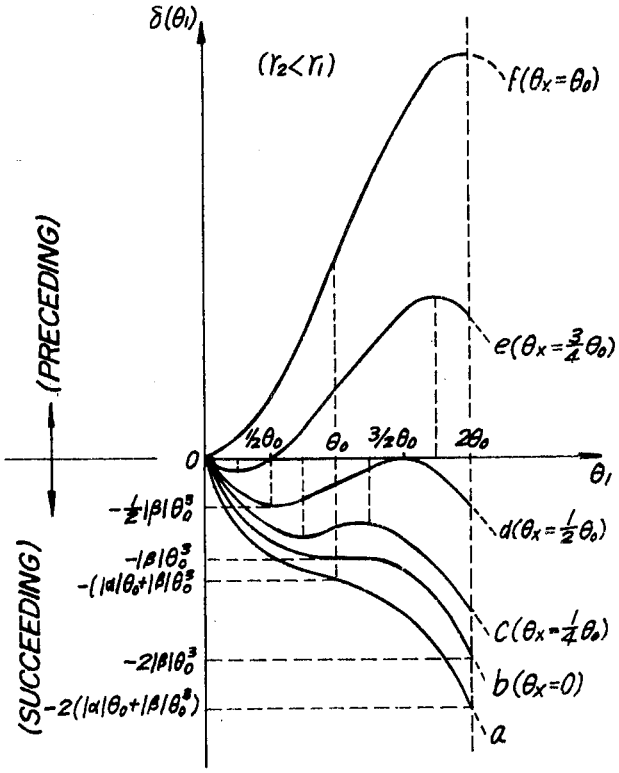

The equations (22) and (22)' are represented by a curve a in FIG. 6 and by a curve a in FIG. 7, respectively.

(2) In case of $k = \frac{r_2(2r_1 + d)}{r_1(2r_2 + d)}$ $$\delta(\theta_1) = \beta\theta_1(\theta_1^2 - 3\theta_0\theta_1 + 3\theta_0^2 \quad (25)$$

For $r_2 < r_1$ $$\delta(\theta_1) = -|\beta|\theta_1(\theta_1^2 - 3\theta_0\theta_1 + 3\theta_0^2) \quad (25)'$$

These equations (25) and (25)' are shown by curves b in FIGS. 6 and 7, respectively.

(3) In case of $$k = \frac{r_2(2r_1 + d)}{r_1(2r_2 + d)} + \frac{r_2(r_2 - r_1)(2r_1 + d)(r_1 + r_2 + d)}{r_1(2r_2 + d)}\theta_x^2$$

The following equations can be derived:

$$\delta(\theta_1) = \beta\theta_1\{\theta_1^2 - 3\theta_0\theta_1 + 3(\theta_0^2 - \theta_x^2)\} \quad (26)$$

In case of $r_2 < r_1$ $$\delta(\theta_1) = -|\beta|\theta_1\{\theta_1^2 - 3\theta_0\theta_1 + 3(\theta_0^2 - \theta_x^2)\} \quad (26)'$$

Wherein $\theta_x$ is an angle made by a segment $\overline{\theta_1 x}$ between a point x on the screen drum 1 and the center $O_1$ and the segment $\overline{O_1C_1}$. $\theta_x$ can be any value, but here it is sufficient to consider that $\theta_x$ is in the charging range, i.e. $0 \leqq \theta_x \leqq 2\theta_0$. The equations (26) and (26)' change depending on the value of the $\theta_x$. For the equation (26) if $\theta_x \leqq \frac{1}{2}\theta_0$, $\delta(\theta_1) \leqq 0$ within a range of $0 \leqq \theta_1 \leqq 2\theta_0$, and if $\theta_x > \frac{1}{2}\theta_0$, $\delta(\theta_1) > 0$. $\delta(\theta_1) > 0$ means that the dot positions formed on the record medium as the point P in FIG. 5 moves from $C_1$ to $B_1$ through $A_1$ precede the dot formed at the point $C_2$ on the record medium. Similarly $\delta(\theta_1) \leqq 0$ means that the dot positions on the record carrier succeed the dot formed at the point $C_2$ on the record medium during the point P moves over the point $C_1$, $A_1$ and $B_1$.

Curves c, d, e and f in FIGS. 6 and 7 represent the equations (26) and (26)', respectively for $\theta_x = \frac{1}{4}\theta_0$, $\theta x = \frac{1}{2}\theta_0$, $\theta_x = \frac{3}{4}\theta_0$ and $\theta_x = \theta_0$. In FIGS. 6 and 7 the maximum amplitudes of the curves represent amounts of dot prolongation within the range of $0 \leqq \theta_1 \leqq 2\theta_0$, when the record medium is rotated at the peripheral speed $v_2(\theta_x)$.

As can been seen from FIGS. 6 and 7 the amount of prolongation becomes decreased as $\theta_x$ becomes larger and has the minimum value at a given value of $\theta_x$. As $\theta_x$ becomes greater than this given value the amount of dot prolongation becomes extremely large. Next the optimal value for $\theta_x$ will be calculated.

(a) In case of $0 \leqq \theta_x \leqq \frac{1}{2}\theta_0$

When the amount of dot prolongation is expressed as $\Delta(\theta_x)$, the following equation can be obtained:

$$\Delta(\theta_x) = \delta(2\theta_0) = 2\beta\theta_0(\theta_0^2 - 3\theta_x^2) = -2\beta\theta_0(\sqrt{3}\,\theta_x - \theta_0)(\sqrt{3}\,\theta_x + \theta_0) \quad (27)$$

For $r_2 < r_1$ one can obtain the following equation:

$$\Delta(\theta_x) = |\delta(2\theta_0)| = -2|\beta|\theta_0(\sqrt{3}\,\theta_x - \theta_0)(\sqrt{3}\,\theta_x + \theta_0) \quad (27)'$$

(b) In case of $\frac{1}{2}\theta_0 < \theta_x \leqq \theta_0$

When it is assumed that $d\delta(\theta_1)/d\theta_1 = \delta'(\theta_1)$ and two roots of an equation $\delta'(\theta_1) = 0$ are $k_1(\theta_x)$ and $k_2(\theta_x)$, the following equation can be derived:

$$\Delta(\theta_x) = |\delta(k_1) - \delta(k_2)| = 4\beta\theta_x^3 \quad (28)$$

for $r_2 < r_1$, the following equation may be derived:

$$\Delta(\theta_x) = 4|\beta|\theta_x^3 \quad (28)'$$

(3) In case of $\theta_x > \theta_0$ $$\Delta_{(\theta x)} = |\delta(2\theta_0)| = 2\beta\theta_0(3\theta_x^2 - \theta_0^2) = 2\beta\theta_0(\sqrt{3}\,\theta_x - \theta_0)(\sqrt{3}\,\theta_x + \theta_0) \quad (29)$$

is obtained.

For $r_2 < r_1$, $$\Delta(\theta_x) = 2|\beta|\theta_0(\sqrt{3}\theta_x - \theta_0)(\sqrt{3}\theta_x + \theta_0) \quad (29)'$$

can be derived.

Figure 8:
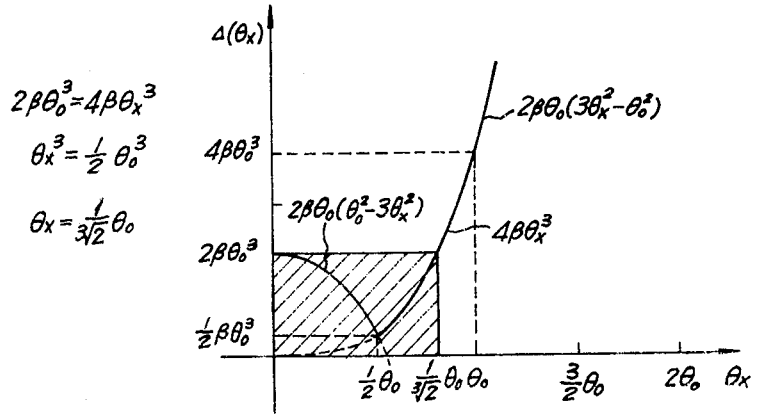
FIG. 8 is a graph illustrating a relation between the minimum dot prolongation and the peripheral velocity ratio.

The results obtained by the equations (27), (28) and (29) are shown in FIG. 8. The results which would be obtained from the equations (27)', (28)' and (29)' for $r_2 < r_1$ will be the same as those shown in FIG. 8 only by converting $\alpha$ and $\beta$ into $|\alpha|$ and $|\beta|$, respectively. From FIG. 8 it is apparent that when $\theta_x = \frac{1}{2}\theta_0$, i.e.

$$k = \frac{v_2}{v_1} = \frac{r_2(2r_1 + d)}{r_1(2r_2 + d)} + \frac{r_2(r_2 - r_1)(2r_1 + d)(r_1 + r_2 + d)}{4r_1(2r_2 + d)^3}\theta_0^2 = \frac{r_2(2r_1 + d)}{r_1(2r_2 + d)} + \frac{r_2(r_2 - r_1)(2r_1 + d)(r_1 + r_2 + d)}{r_1(2r_2 + d)^3}\left(\frac{W}{4r_1}\right)^2 \quad (30)$$

the amount of dot prolongation has the minimum value $\Delta$min, $$\Delta\min = \frac{1}{2}|\beta|\,\theta_0^3$$

-continued $$= \frac{r_2|r_2 - r_1|(2r_1 + d)(r_1 + r_2 + d)}{6(2r_2 + d)^3} \left(\frac{W}{2r_1}\right)^3 \quad (31)$$

In these equations (30) and (31) W means the charging or printing width ($W = 2r_1\theta_0$).

In order to effect a high speed printing with the image forming apparatus having the screen drum the printing corona generator should have a given finite charging or printing width W. For the given charging width W the ratio of the rotating peripheral speeds of the screen drum and the record medium can be determined in accordance with the above mentioned equation (30) and then the charged dot has the minimum dot prolongation Δmin given by the equation (31) so as to obtain a sharp copy image of high resolution. In some applications of the image forming apparatus explained hereinbefore it is desirable to establish various allowable values Δ of the dot expansion. For instance, in case of printing characters and marks which are ordinarily used, it is not necessary to decrease unnecessarily the dot prolongation Δ, but the dot prolongation up to about 100 μm may be allowable. However in case of printing special documents such as photographic documents the dot expansion should be limited to about 20 – 80 μm. Even in these cases by determining the ratio of the speeds of the screen drum and the record carrier in accordance with the equation (30), the maximum charging width Wmax can be calculated from the equation (31) within each allowable amount of dot prolongation. The maximum charging width Wmax can be represented as follows:

$$W\max = 2r_1(2r_2 + d)\left\{\frac{6\Delta}{r_2|r_2 - r_1|(2r_1 + d)(r_1 + r_2 + d)}\right\}^{\frac{1}{3}} \quad (32)$$

As explained above in the image forming apparatus in which the ion stream is modulated with the electrostatic latent image formed on the photosensitive screen drum so as to form a copy image on the record medium arranged opposite to the screen drum it is possible to minimize the prolongation of dot by determining the rotating peripheral velocities of the screen drum and the record medium in accordance with the equation (30) for the given finite charging or printing width W which is determined in accordance with the application and purpose of the image forming apparatus.

As will be clear from the following Table 1 the second term in the equation (30) is very small as compared with the first term and in many cases lower than 1% of the first term. Thus with considering various limitations upon designing the apparatus it is advantageous to make an allowable margine substantially equal to the second term for the equation (30). That is to say it is convenient to select the velocity ratio $k = v_2/v_1$ within the following range: in case of $r_2 > r_1$, $$\frac{r_2(2r_1 + d)}{r_1(2r_2 + d)} < \left(\frac{v_2}{v_1}\right) < \frac{r_2(2r_1 + d)}{r_1(2r_2 + d)} + \frac{r_2(r_2 - r_1)(2r_1 + d)(r_1 + r_2 + d)}{\sqrt[3]{4}\, r_1(2r_2 + d)^3}\theta_0^2 \quad (33)$$

or in case of $r_2 < r_1$,

-continued $$\frac{r_2(2r_1 + d)}{r_1(2r_2 + d)} > \frac{v_2}{v_1} > \frac{r_2(2r_1 + d)}{r_1(2r_2 + d)} - \frac{r_2(r_1 - r_2)(2r_1 + d)(r_1 + r_2 + d)}{\sqrt[3]{4}\, r_1(2r_2 + d)^3}\theta_0^2 \quad (33)'$$

For such a velocity ratio the amount Δ of dot prolongation is given as follows from FIG. 8.

$$\frac{1}{2}|\beta|\theta_0^3 \leqq \Delta < 2|\beta|\theta_0^3$$

$$\frac{r_2|r_2 - r_1|(2r_1 + d)(r_1 + r_2 + d)}{6(2r_2 + d)^3}\theta_0^3 \leqq \Delta < \frac{2r_2|r_2 - r_1|(2r_1 + d)(r_1 + r_2 + d)}{3(2r_2 + d)^3}\theta_0^3 \quad (34)$$

The amount Δ of dot prolongation given by the equation (34) is extremely smaller than that is obtained for the case of $v_1 = v_2$.

Now the operational effect of the invention will shown in the following Tables.

TABLE I

| W (mm) | $r_1$ (mm) | $r_2$ (mm) | d (mm) | $k_0$ (1st term) | $k_2$ (2nd term) | $k_2/k_0$ |
|---|---|---|---|---|---|---|
| | 50 | 100 | 3 | 1.01478 | 0.00188 | 0.00186 |
| | 100 | 120 | 5 | 1.00408 | 0.00019 | 0.00019 |
| 20 | 100 | 200 | 5 | 1.01235 | 0.00047 | 0.00046 |
| | 100 | ∞ | 5 | 1.02500 | 0.00064 | 0.00063 |
| | 100 | 80 | 5 | 0.99394 | 0.00034 | 0.00034 |
| | 50 | 100 | 3 | 1.01478 | 0.00754 | 0.00743 |
| | 100 | 120 | 5 | 1.00408 | 0.00075 | 0.00075 |
| 40 | 100 | 200 | 5 | 1.01235 | 0.00188 | 0.00186 |
| | 100 | ∞ | 5 | 1.02500 | 0.00256 | 0.00250 |
| | 100 | 80 | 5 | 0.99394 | 0.00135 | 0.00136 |
| | 50 | 100 | 3 | 1.01478 | 0.01695 | 0.01671 |
| | 100 | 120 | 5 | 1.00408 | 0.00169 | 0.00169 |
| 60 | 100 | 200 | 5 | 1.01235 | 0.00424 | 0.00418 |
| | 100 | ∞ | 5 | 1.02500 | 0.00577 | 0.00563 |
| | 100 | 80 | 5 | 0.99394 | 0.00304 | 0.00306 |

Note:

$$k_0 = \frac{r_2(2r_1 + d)}{r_1(2r_2 + d)},$$

$$k_2 = \frac{r_2|r_2 - r_1|(2r_1 + d)(r_1 + r_2 + d)}{r_1(2r_2 + d)^3}\left(\frac{W}{4r_1}\right)^2$$

Next the amounts Δ(mm) of dot prolongation will be calculated for three different velocity ratios $v_2/V_1 = 1$, $v_2/v_1 = k_0$ and $v_2/v_1 = k_0 + k_2$ and four different charging width W(mm). It should be noted that in the following Tables 2 to 6, $$k_0 = \frac{r_2(2r_1 + d)}{r_1(2r_2 + d)},$$

$$k_2 = \frac{r_2(r_2 - r_1)(2r_1 + d)(r_1 + r_2 + d)}{r_1(2r_2 + d)^3}\left(\frac{W}{4r_1}\right)^2$$

is assumed.

Numerical Example 1

$r_1 = 50$ mm, $r_2 = 100$ mm, $d = 3$ mm

TABLE 2

| Velocity | W(mm) 10 | 20 | 30 | 40 |
|---|---|---|---|---|
| $v_2 = v_1$ | 0.15406 | 0.34580 | 0.61289 | 0.99302 |
| $v_2 = k_0 v_1$ | 0.00628 | 0.05024 | 0.16954 | 0.40188 |
| $v_2 = (k_0 + k_2)v_1$ | 0.00157 | 0.01256 | 0.04239 | 0.10047 |

Numerical Example 2

$r_1 = 100$ mm, $r_2 = 120$ mm, $d = 5$ mm

TABLE 3

| | W(mm) | | | | | |
|---|---|---|---|---|---|---|
| Velocity | 10 | 20 | 30 | 40 | 50 | 60 |
| $v_2=v_1$ | 0.04144 | 0.8665 | 0.13939 | 0.20341 | 0.28249 | 0.38039 |
| $v_2=k_0v_1$ | 0.00063 | 0.00502 | 0.01694 | 0.04015 | 0.07841 | 0.13549 |
| $v_2=(k_0+k_2)v_1$ | 0.00016 | 0.00125 | 0.00423 | 0.01004 | 0.01960 | 0.03387 |

Numerical Example 3

$r_1 = 100$ mm, $r_2 = 200$ mm, $d = 5$ mm

TABLE 4

| | W(mm) | | | | | |
|---|---|---|---|---|---|---|
| Velocity | 10 | 20 | 30 | 40 | 50 | 60 |
| $v_2=v_1$ | 0.12503 | 0.25946 | 0.41273 | 0.59422 | 0.81337 | 1.07958 |
| $v_2=k_0v_1$ | 0.00157 | 0.01255 | 0.04235 | 0.10040 | 0.19609 | 0.33884 |
| $v_2=(k_0+k_2)v_1$ | 0.00039 | 0.00314 | 0.01059 | 0.02510 | 0.04902 | 0.08471 |

Numerical Example 4

$r_1 = 100$ mm, $r_2 = \infty$, $d = 5$ mm

TABLE 5

| | W(mm) | | | | | |
|---|---|---|---|---|---|---|
| Velocity | 10 | 20 | 30 | 40 | 50 | 60 |
| $v_2=v_1$ | 0.25214 | 0.51718 | 0.80766 | 1.13667 | 1.51693 | 1.96125 |
| $v_2=k_0v_1$ | 0.00214 | 0.01708 | 0.05766 | 0.13667 | 0.26693 | 0.46125 |
| $v_2=(k_0+k_2)v_1$ | 0.00053 | 0.00427 | 0.01441 | 0.03417 | 0.06673 | 0.11531 |

Numerical Example 5

$r_1 = 100$ mm, $r_2 = 80$ mm, $d = 5$ mm

TABLE 6

| | W(mm) | | | | | |
|---|---|---|---|---|---|---|
| Velocity | 10 | 20 | 30 | 40 | 50 | 60 |
| $v_2=v_1$ | 0.06173 | 0.13022 | 0.21221 | 0.31447 | 0.44374 | 0.60678 |
| $v_2=k_0v_1$ | 0.00113 | 0.00901 | 0.03039 | 0.07204 | 0.14071 | 0.24315 |
| $v_2=(k_0+k_2)v_1$ | 0.00028 | 0.00225 | 0.00760 | 0.01801 | 0.03518 | 0.06079 |

As can be seen from the above examples when the circumferential velocity $v_2$ of the record medium is selected to the optimum value, i.e.

$$v_2 = kv_1 = (k_0 + k_2)v_1,$$

the amount of dot expansion can be kept practically negligibly small, even if the charging width W is selected to 50 - 60 mm.

The present invention is not limited to the embodiments so far described, but many modifications are possible within the scope of the invention. For instance, in the above embodiment use is made of transferring drum as the record medium, but it is possible to use a copy paper as the record medium. But in such a case since the paper could not constitute the drum the paper is guided to move along an arcuate passage having the radius $r_2$. Moreover, the photosensitive screen is not necessary to form the drum, but may be any other form. For example, the photosensitive screen may be formed as a flexible belt and the belt may be moved along the arcuate passage having the radius $r_2$ at the charging or printing area in which the belt faces against the record medium.

What is claimed is:

1. An electrophotographic apparatus comprising a photosensitive screen having a number of small apertures formed therein and traveling through a printing area along an arcuate passage having a radius $r_1$ at a constant peripheral velocity $v_1$;

a record medium arranged opposite to the photosensitive screen with a distance d at the printing area and traveling through the printing area along an arcuate passage having a radius $r_2(r_2 \neq r_1)$ at a constant peripheral velocity $v_2$;

means for forming on the photosensitive screen an electrostatic latent image corresponding to a document to be copied; and means for generating a corona ion stream which passes in the printing area through the apertures of the screen to the record medium and has a charging or printing width W; wherein a ratio k of the peripheral velocities $v_1$ and $v_2$ of said photosensitive screen and record medium satisfies the following equation:

for $r_2 > r_1$ $$\frac{r_2(2r_1+d)}{r_1(2r_2+d)} < k\left(=\frac{v_2}{v_1}\right) < \frac{r_2(2r_1+d)}{r_1(2r_2+d)} + \frac{r_2(r_2-r_1)(2r_1+d)(r_1+r_2+d)}{\sqrt[3]{4}\, r_1(2r_2+d)^3}\cdot\left(\frac{W}{2r_1}\right)^2$$

for $r_2 < r_1$ $$\frac{r_2(2r_1+d)}{r_1(2r_2+d)} > k\left(=\frac{v_2}{v_1}\right) > \frac{r_2(2r_1+d)}{r_1(2r_2+d)} - \frac{r_2(r_1-r_2)(2r_1+d)(r_1+r_2+d)}{\sqrt[3]{4}\, r_1(2r_2+d)^3}\cdot\left(\frac{W}{2r_1}\right)^2.$$

2. An electrophotographic apparatus according to claim 1, wherein said ratio k of peripheral velocities of the photosensitive screen and record medium substantially satisfies the following equation:

$$k = \frac{v_2}{v_1} = \frac{r_2(2r_1+d)}{r_1(2r_2+d)} + \frac{r_2(r_2-r_1)(2r_1+d)(r_1+r_2+d)}{r_1(2r_2+d)^3}\left(\frac{W}{4r_1}\right)^2.$$

3. An electrophotographic apparatus according to claim 1, wherein said photosensitive screen is formed as a photosensitive screen drum having the radius $r_1$ and rotating at the constant peripheral velocity $v_1$.

4. An electrophotographic apparatus according to claim 1, wherein said record medium is of a member for transferring an electrostatic charge image.

5. An electrophotographic apparatus according to claim 4, wherein said transferring member is formed as a drum which has the radius $r_2$ and rotates at the constant peripheral velocity $v_2$.

6. An electrophotographic apparatus according to claim 1, wherein said record medium is of a paper which is fed through the printing area along the arcuate passage having the radius $r_2$ at the peripheral velocity $v_2$.

* * * * *